United States Patent [19]

Morofushi

[11] Patent Number: 5,066,196

[45] Date of Patent: Nov. 19, 1991

[54] ENGINE-COOLING FAN MADE OF SYNTHETIC RESIN

[75] Inventor: Kunitoshi Morofushi, Shizuoka, Japan

[73] Assignee: Usui Kokusai Sangyo Kabushiki Kaisha, Japan

[21] Appl. No.: 379,705

[22] Filed: Jul. 14, 1989

Related U.S. Application Data

[63] Continuation of Ser. No. 184,257, Apr. 21, 1988, abandoned.

[51] Int. Cl.[5] ..... F01D 5/14

[52] U.S. Cl. ..... 416/241 A; 416/234

[58] Field of Search ..... 416/241 A, 234, 239, 416/236 R, 236 A, 194

[56] References Cited

U.S. PATENT DOCUMENTS

| | | | |
|---|---|---|---|
| D. 131,271 | 2/1942 | Collura | 416/236 A |
| 2,346,552 | 4/1944 | Brotz | 416/241 A |
| 2,785,009 | 3/1957 | Stocking | 416/241 A |
| 2,801,793 | 8/1957 | Kline | 416/234 |
| 3,033,049 | 5/1962 | Morrow | 416/194 |
| 3,071,315 | 1/1963 | Alis | 416/241 A |
| 3,951,611 | 4/1976 | Morrill | 416/234 |
| 4,671,739 | 6/1987 | Read et al. | 416/234 |
| 4,721,394 | 1/1988 | Casto et al. | 416/241 A |

FOREIGN PATENT DOCUMENTS

| | | | |
|---|---|---|---|
| 74403 | 7/1952 | Denmark | 416/236 A |
| 762625 | 3/1954 | Fed. Rep. of Germany | 416/194 |
| 1008258 | 5/1957 | Fed. Rep. of Germany | 416/236 |
| 55-48797 | 11/1980 | Japan . | |
| 57-30473 | 7/1982 | Japan . | |

*Primary Examiner*—John T. Kwon

*Attorney, Agent, or Firm*—Lowe, Price, LeBlanc & Becker

[57] ABSTRACT

An engine-cooling fan is made of a synthetic resin, and includes a cylindrical hub, a plurality of fan blades provided integrally and radially on an outer peripheral wall of the hub and an integral member provided on an inner peripheral wall of the hub for mounting the fan on a drive shaft extending at a right angle relative to a plane in which the fan blades lie. At least one reinforcing rib is integrally molded between the outer peripheral wall of the hub and a heel portion of each of the blades.

7 Claims, 5 Drawing Sheets

ENGINE-COOLING FAN MADE OF SYNTHETIC RESIN

This application is a continuation of application Ser. No. 07/184,257, filed Apr. 21, 1988, now abandoned.

FIELD OF THE INVENTION

This invention relates to an axial-flow engine-cooling fan driven to cool an internal combustion engine of an automobile or a similar engine, more specifically, to an engine-cooling fan made of a synthetic resin (may hereinafter be called "engine-cooling plastic fan") and having a reinforced structure composed of a hub and fan blades molded as an integral unit.

BACKGROUND OF THE INVENTION

As an engine-cooling fan for an internal combustion engine of an automobile or a similar engine, there has been known a fan in which a cylindrical hub and a plurality of fan blades provided radially on the outer peripheral wall of the hub are integrally injection-molded using a synthetic resin as a raw material.

Incidentally, an engine-cooling fan is used under the influence of violent vibrations of an engine and moreover, at a high revolutionary speed. Thus, the engine-cooling fan is repeatedly subjected to influence such as resonance phenomena due to vibrations of the engine or reaction forces of wind pressures. However, conventional engine-cooling plastic fans often developed cracked damages due to fatigue because the rigidity of the connecting part between each fan blade and its associated hub was not sufficient.

It may hence be contemplated, for example, of increasing the thickness of a heel portion of each fan blade or the curvature of radius of the heel portion of each fan blade so as to increase the rigidity of a connecting part between the heel portion and the hub. An approach of this sort is however accompanied by a drawback that where the hub and fan blades are injection-molded integrally with a synthetic resin, one or more cavities may be formed within the thus-thickened portion or an irregular deformation may occur due to molding sink near the thickened portion and the fatigue strength may hence be reduced on the contrary.

OBJECTS AND SUMMARY OF THE INVENTION

An object of this invention is to provide an axial-flow engine-cooling plastic fan which has a reinforced structure and is driven for rotation.

Another object of this invention is to provide an engine-cooling plastic fan having fatigue strength improved at a connecting part between a hub and a heel portion of each fan blade.

A further object of this invention is to mold, as an integral unit, an engine-cooling fan of a reinforced structure by injection-molding a synthetic resin.

The above objects of this invention have been attained by an engine-cooling fan made of a synthetic resin. The fan includes a cylindrical hub, a plurality of fan blades provided integrally and radially on an outer peripheral wall of the hub, and a member provided as an integral member inside the hub for mounting the fan on a drive shaft extending at a right angle relative to a plane in which the fan blades lie. At least one reinforcing rib is integrally molded between the outer peripheral wall of the hub and a heel portion of each of the blades.

According to the present invention, an engine-cooling plastic fan improved significantly in fatigue strength at a connecting part between a hub and each fan blade can be easily obtained as an integral unit by injection molding.

DETAILED DESCRIPTION OF THE INVENTION

The present invention will hereinafter be described in detail with reference to the accompanying drawings.

Figure 1:
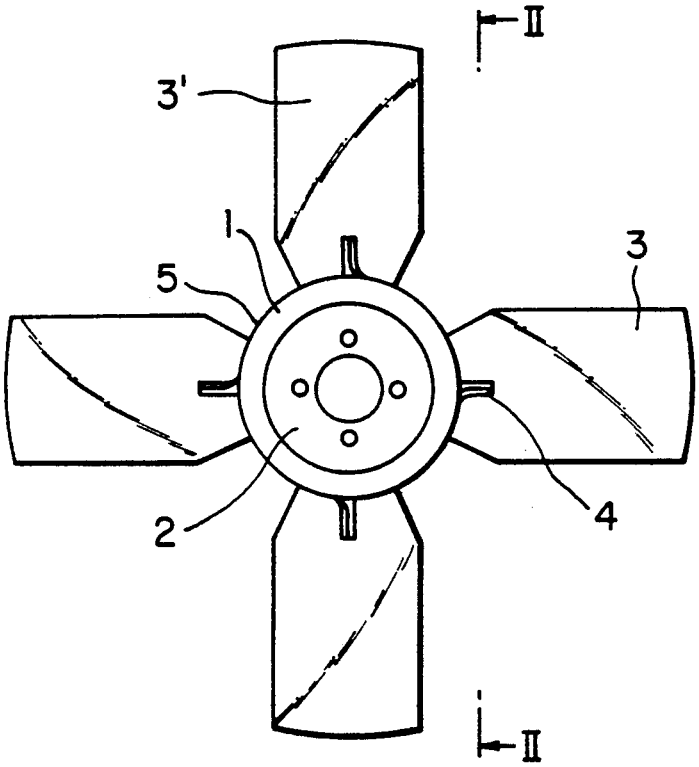
FIG. 1 is a front view of an engine-cooling plastic fan according to a first embodiment of this invention.
Figure 2:
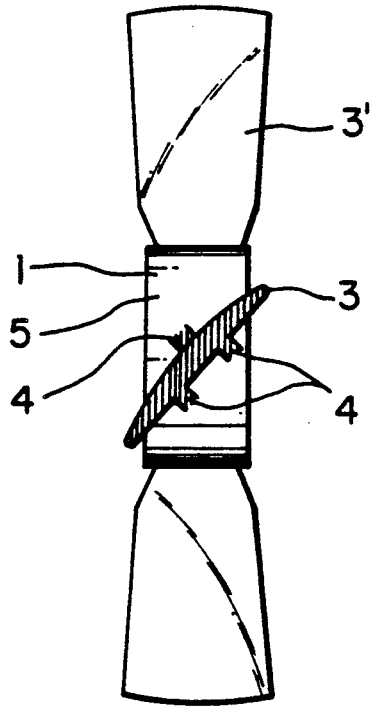
FIG. 2 is a cross-sectional view taken along line II—II of FIG. 1.

Referring first to FIGS. 1 and 2, the engine-cooling plastic fan according to the first embodiment of this invention will be described. Numeral 1 indicates a cylindrical hub made of a synthetic resin. Designated at numerals 3,3', . . . are four fan blades provided radially and integrally on an outer peripheral wall of the hub 1. Inside the hub 1, a member 2 is integrally provided for mounting the fan on an unillustrated drive shaft extending at a right angle relative to a plane in which the fan blades 3,3', . . . lie. Each of the fan blades 3,3', . . . is formed of a curved plate having a curved configuration predetermined such that the blade chord angle (8) [see FIG. 11] is not greater than 50° from the standpoint of air-blowing efficiency.

Numeral 4 indicates reinforcing ribs which are each provided between the outer peripheral wall of the hub and a heel portion of its corresponding one of the fan blades 3,3', . . . Each rib 4 extends substantially at a right angle relative to its corresponding fan blade. The word "substantially" is used to reflect the curved configuration of the fan blade. In the first embodiment, one reinforcing rib is provided on the front (i.e., windway) side of each fan blade and two reinforcing ribs are provided on the rear (i.e., leeway) side of each fan blade. These hub 1, fan blades 3,3', . . . and reinforcing ribs 4 have been injection-molded as an integral unit with a synthetic resin.

The synthetic resin useful in the practice of this invention may be any one of synthetic resins which are employed generally for the fabrication of engine cooling plastic fans. No particular limitation is therefore imposed on the synthetic resin. As specific examples, may be mentioned polypropylene, nylon, and resin compositions obtained by adding a reinforcing material such as glass fibers to these resins. Although polypropylene is generally used, polypropylene reinforced with glass fibers, nylon, or nylon reinforced with glass fibers is used where higher heat resistance and strength are required.

In the engine-cooling plastic fan illustrated in FIGS. 1 and 2, a performance test was conducted using a sample in which the outer diameter of the fan blades 3,3', . . . was 390 mm. As a result, the characteristic frequency was found to be 165 Hz. Incidentally, polypropylene was used as the synthetic resin. On the other hand, a cooling fan of the same type as the sample except for the exclusion of the reinforcing ribs was found to have a characteristic frequency of 115 Hz. The engine-cooling plastic fan according to the first embodiment of this invention does not have any resonance point within the resonance frequency range of vibrations caused by revolution of a conventional automobile engine. It is hence possible to effectively prevent the occurrence of vibrations of the fan due to resonance and also the breakage of the blades due to resonance fatigue. It is also worthy to note that the performance of the fan, such as air capacity and noise level, was not affected practically.

Figure 3:
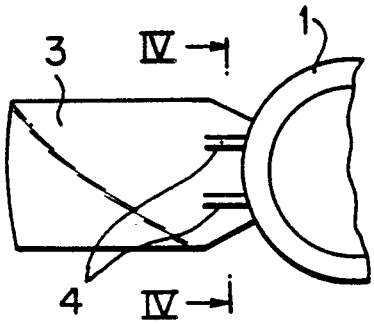
FIG. 3 is a fragmentary rear view of an engine-cooling plastic fan according to a second embodiment of this invention.
Figure 4:
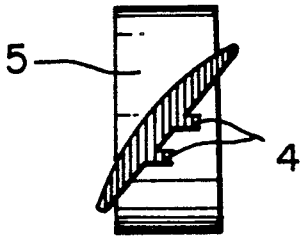
FIG. 4 is a cross sectional view taken along line IV—IV of FIG. 3.

The engine-cooling plastic fan according to the second embodiment of this invention will next be described with reference to FIGS. 3–5. The reinforcing ribs 4 are provided in parallel to an imaginary central axis of the hub 1. An upper edge 6 of each reinforcing rib 4, which upper edge 6 is opposite to a lower edge at which the reinforcing rib 4 is connected to the associated fan blade 3, extends at an acute angle relative to the corresponding fan blade 3. Two reinforcing ribs 4 are provided in parallel to each other with each fan blade 3. The use of such a structure can facilitate the production of a mold for the fan and moreover, can reduce the wind noise level during rotation of the fan.

Figure 6:
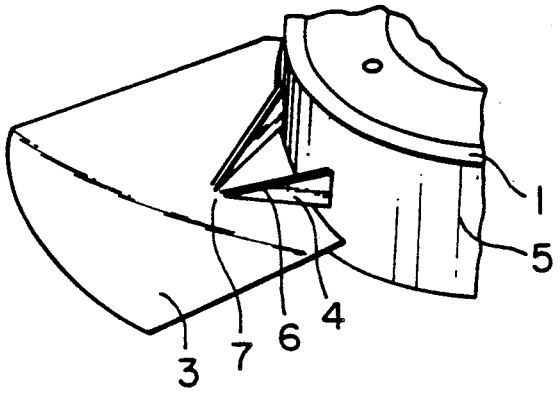
FIG. 6 is a fragmentary perspective rear view of an engine-cooling plastic fan according to a third embodiment of this invention.

FIG. 6 illustrates the engine-cooling plastic fan according to the third embodiment of this invention. In the third embodiment, the upper edge 6 of each rib 4 is formed aslant relative to the corresponding fan blade, and tip portions 7 of the reinforcing ribs 4,4 are arranged in a pair directed toward each other. The use of such a structure has an advantage that a stress component applied in parallel to one of the ribs 4,4 can be borne by the other rib 4.

Figure 7:
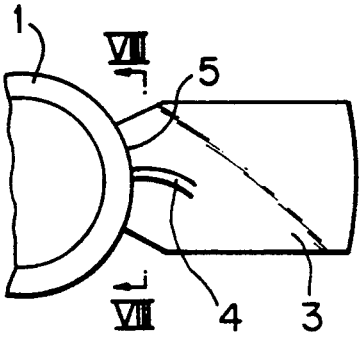
FIG. 7 is a fragmentary perspective view of an engine-cooling plastic fan according to a fourth embodiment of this invention.
Figure 8:
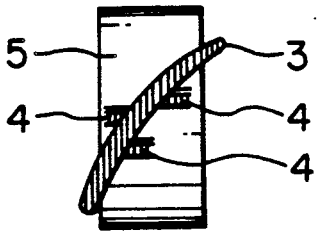
FIG. 8 is a cross-sectional view taken along line VIII—VIII of FIG. 7.
Figure 9:
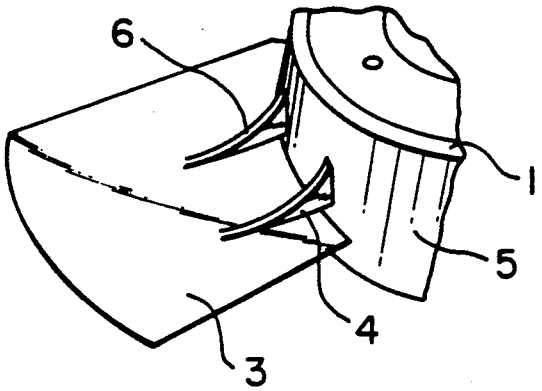
FIG. 9 is a fragmentary rear perspective view of the engine-cooling plastic fan motor of the fourth embodiment.

With reference to FIGS. 7–9, the engine-cooling plastic fan according to the fourth embodiment of this invention is now described. One reinforcing rib 4 is provided on the front (i.e., windway) side of each of the fan blades 3,3', . . . and two reinforcing ribs 4,4 are provided on the rear (i.e., leeway) side of the fan blade. It is a characteristic feature of the fourth embodiment that each reinforcing rib 4 is formed in a curved shape as shown in FIGS. 7 and 9. The inner end portion of each reinforcing rib 4, at which the reinforcing rib 4 is connected to the outer peripheral wall 5, extends in parallel with the imaginary central axis of the hub 1 (the fourth embodiment is hence similar to the second embodiment depicted in FIGS. 3–5 in this concern) but the remaining portion of the reinforcing rib 4 is curved and is not in parallel with the imaginary central axis of the hub 1 (it is here that the fourth embodiment differs from the second embodiment). The curved configuration of the reinforcing ribs 4 has a merit that the flow of air along the surface of each fan blade is not disturbed. As best shown in FIG. 9, each reinforcing rib 4 has a curved configuration and its upper edge 6 is concave. This structure further facilitates the smooth flow of air along the surface of each fan blade.

Figure 10:
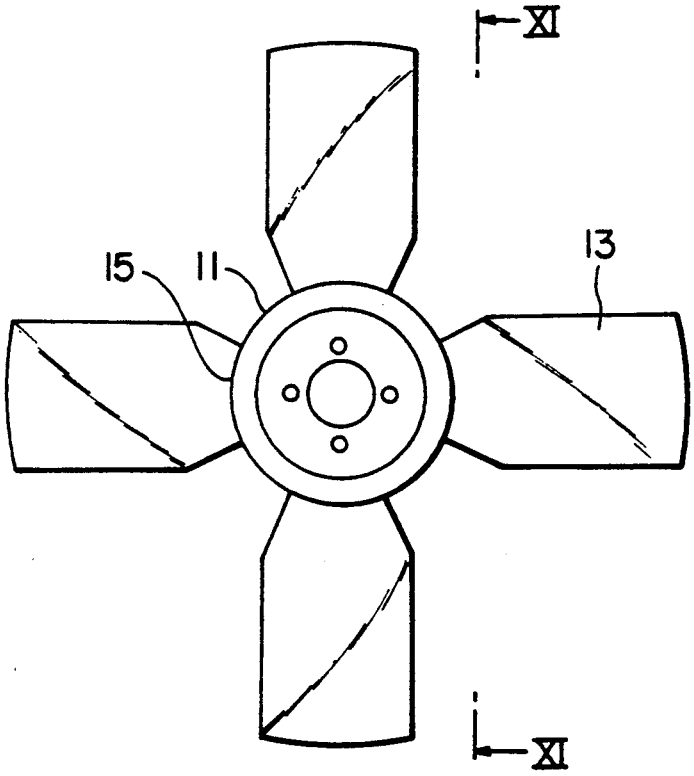
FIG. 10 (PRIOR ART)
FIG. 10 is a front view showing a conventional engine-cooling plastic fan equipped with no reinforcing ribs.
Figure 11:
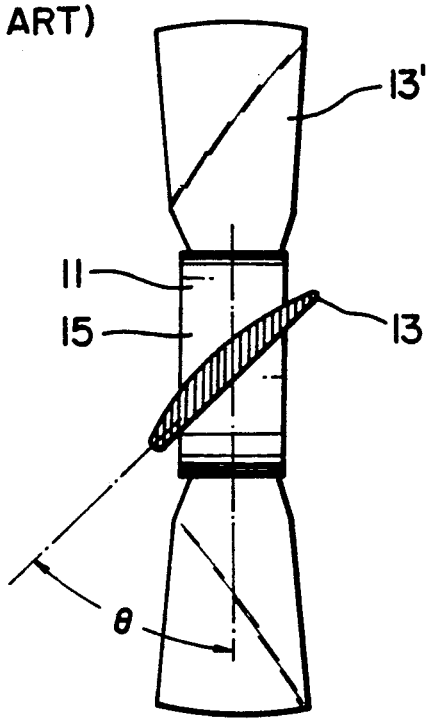
FIG. 11 (PRIOR ART)
FIG. 11 is a cross-sectional view taken along line XI—XI of FIG. 10.

FIGS. 10 and 11 illustrate the conventional engine-cooling plastic fan. Numeral 11 indicates a cylindrical hub made of a synthetic resin. Four fan blades 13,13', . . . are radially provided at equal intervals, namely, at 90° intervals on an outer peripheral wall 15 of the hub 11. As already described above, $\theta$ indicates the blade chord angle.

Like the conventional engine-cooling plastic fan, the blade chord angle ($\theta$) of each engine-cooling plastic fan according to this invention is not greater than 50°. If the blade chord angle ($\theta$) is greater than 50°, each blade itself plays a rib-like role against vibrations. Even if a reinforcing rib is provided, the reinforcing rib cannot bring about any additional reinforcing effects.

In the present invention, a desired number of reinforcing ribs may be provided on the front (i.e., windway) side, rear (i.e., leeway) side or both front and rear sides of each fan blade as provided in the above embodiments, while taking the size and material of the fan blade and the use conditions into parallel consideration.

Reinforcing ribs

Preferred embodiments of the reinforcing ribs in this invention will next be described more specifically.

(a) The thickness of the reinforcing ribs may preferably not exceed the thickness of the fan blades. If the thickness of the reinforcing ribs is too great, the rigidity of the ribs becomes unduly high. As a result, vibration-induced stresses are concentrated at the tips of the ribs. It is hence not preferable to such an unduly large thickness.

Figure 5:
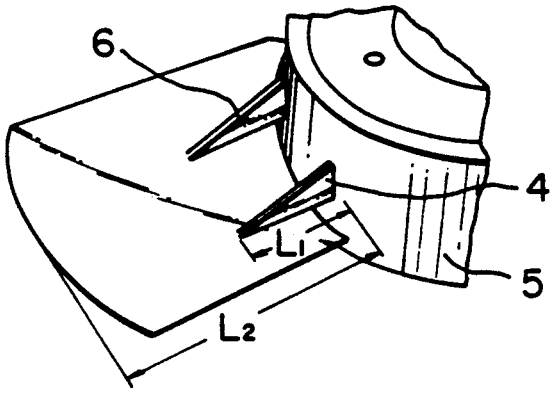
FIG. 5 is a fragmentary perspective view of the engine-cooling plastic fan of FIGS. 3 and 4.

(b) The length ($L_1$) of the lower edge of each reinforcing rib, which is connected at the lower edge to the corresponding fan blade, may preferably be not greater than $\frac{1}{2}$ of the radial length ($L_2$) of the fan blade ($L_1 \leqq \frac{1}{2} \cdot L_2$, see FIG. 5).

Even if the length of the lower edge of the reinforcing rib is made greater unnecessarily, little additional reinforcing effects can be brought about. On the contrary, more deleterious effects are given to the wind which flows along the surface of the corresponding fan blade.

Figure 12:
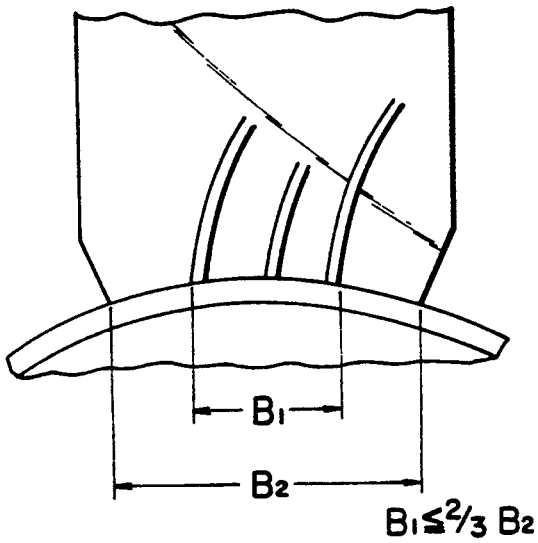
FIG. 12 schematically illustrates the position of reinforcing ribs in an engine-cooling fan according to this invention.

(c) As shown in FIG. 12, the reinforcing ribs may preferably be provided centrally within a range ($B_1$) of two-thirds of the width ($B_2$ in FIG. 2) of the heel of the corresponding blade as measured in a front projection of the corresponding blade ($B_1 \leqq \frac{2}{3} \cdot B_2$).

It is preferable to provide the reinforcing ribs at the above-described positions, because stress becomes maximum around the widthwise center of the fan blade and the strength has to be increased near the widthwise center of the fan blade.

Figure 13A:
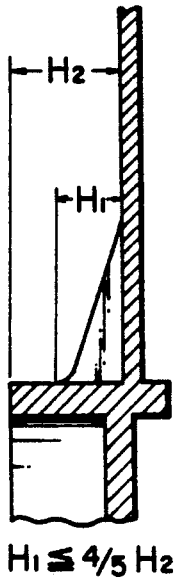
FIGS. 13(*a*) and 13(*b*) schematically depict the axial length of a reinforcing rib.
Figure 13B:
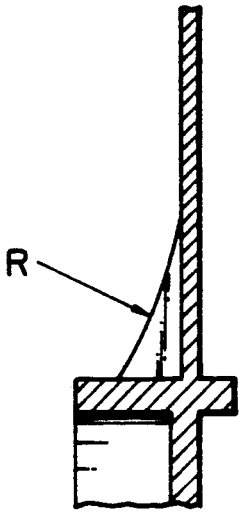

(d) As illustrated in FIGS. 13(*a*) and 13(*b*), the length ($H_1$) of each reinforcing rib as measured in the direction of the imaginary central axis of the hub may preferably be not greater than the four-fifths of the distance ($H_2$)

between an associated side of the corresponding fan blade and an associated axial end of the hub ($H_1 \leqq 4/5 \cdot H_2$). This construction allows to reduction of deleterious influence to wind streams.

The fulfillment of the above-described various conditions can avoid adverse effects such as reduced fan efficiency and increased noise level.

As has been described above, the present invention can improve the flexural rigidity of the fan blades and the tensile strength of their heel portions without giving any deleterious effects to the performance of the fan, such as the air capacity of the fan and the production of noises, by molding at least one reinforcing rib integrally between the outer peripheral wall of the hub and the heel portion of each of the blades. An engine-cooling plastic engine having the reinforced structure of this invention can therefore reduce its vibrations to be caused by resonance with the engine in operation and can improve the fatigue strength of its fan blades, and can also improve its rigidity against air pressures at the time of high-speed revolution. This invention can therefore provide an extremely useful engine-cooling fan.

What is claimed is:

1. In an engine-cooling fan made of a synthetic resin, said fan including a cylindrical hub, a plurality of fan blades provided integrally and radially on an outer peripheral wall of the hub and an integral member provided inside the hub for mounting the fan on a drive shaft extending at a right angle relative to a plane in which the fan blades lie, the improvement wherein at least two reinforcing ribs are integrally molded with the outer peripheral wall of the hub and a heel portion of each of the blades, one of said at least two reinforcing ribs being provided on a windway side of the corresponding blade, and the other one of said at least two reinforcing ribs being provided on a leeway side of the corresponding blade, and wherein an edge of each of said reinforcing ribs connected with the corresponding blade has a length not greater than one half of the radial length of the corresponding blade.

2. The fan as claimed in claim 1, wherein each reinforcing rib is provided substantially at a right angle relative to the corresponding blade.

3. The fan as claimed in claim 1, wherein each reinforcing rib is arranged in parallel with the axial direction of the hub.

4. The fan as claimed in claim 1, wherein each reinforcing rib is formed in a curbed shape, and a portion of each reinforcing rib, at which the reinforcing rib is connected to the outer peripheral wall of the hub, extends in parallel with the axial direction of the hub.

5. The fan as claimed in claim 1, wherein a third reinforcing rib is provided on the leeway side of each blade.

6. The fan as claimed in claim 1, wherein the length of each reinforcing rib as measured in the axial direction of the hub is not greater than four-fifths of the distance between an associated side of the corresponding blade and an associated axial end of the hub.

7. The fan as claimed in claim 1, wherein each reinforcing rib is provided centrally within a range of the two-thirds of the width of the heel of the corresponding blade as measured in a front projection of the corresponding blade.

* * * * *